United States Patent [19]

Chow

[11] Patent Number: 4,762,032

[45] Date of Patent: Aug. 9, 1988

[54] SOCKET RELEASE ASSEMBLY FOR RATCHET DRIVE

[76] Inventor: Kirk K. Chow, 5902 Bent Trail, Dallas, Tex. 75234

[21] Appl. No.: 17,710

[22] Filed: Feb. 24, 1987

[51] Int. Cl.[4] ..... B25B 13/46

[52] U.S. Cl. ..... 81/63; 81/62

[58] Field of Search ..... 81/63, 61, 62, 63.1, 81/63.2, 60, 177.85; 192/43, 43.1

[56] References Cited

U.S. PATENT DOCUMENTS 4,280,379 7/1981 Chow ..... 81/62

4,512,218 4/1985 Chow ..... 81/63

*Primary Examiner*—Frederick R. Schmidt

*Assistant Examiner*—Bradley I. Vaught

*Attorney, Agent, or Firm*—Michael G. Berkman

[57] ABSTRACT

A pin assembly for securing a tool socket in place and for effecting quick release of the tool socket from a socket engagement tang or boss of a ratchet drive wrench. The mechanical structure is specially adapted for use in a ratchet drive wrench of the type in which the drive direction is conveniently changed by simply applying digital pressure to a pivotally-supported toggle element projecting upwardly of the head of the wrench. A wrench of the type referred to is described in K. K. Chow, U.S. Pat. No. 4,280,379.

14 Claims, 3 Drawing Sheets

FIG. 1
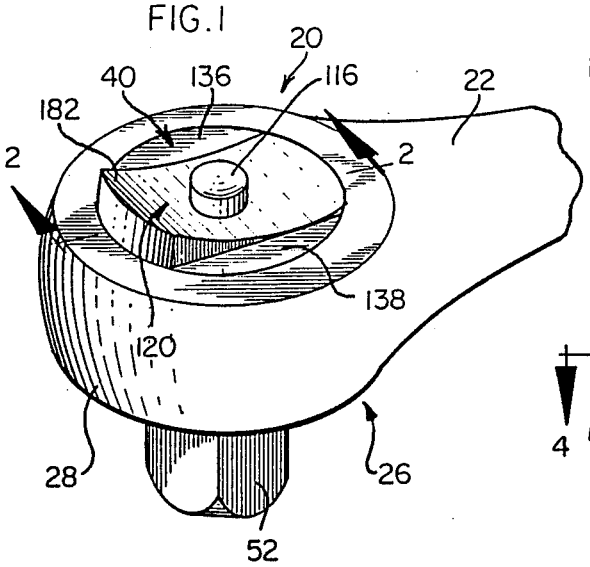
FIG. 2
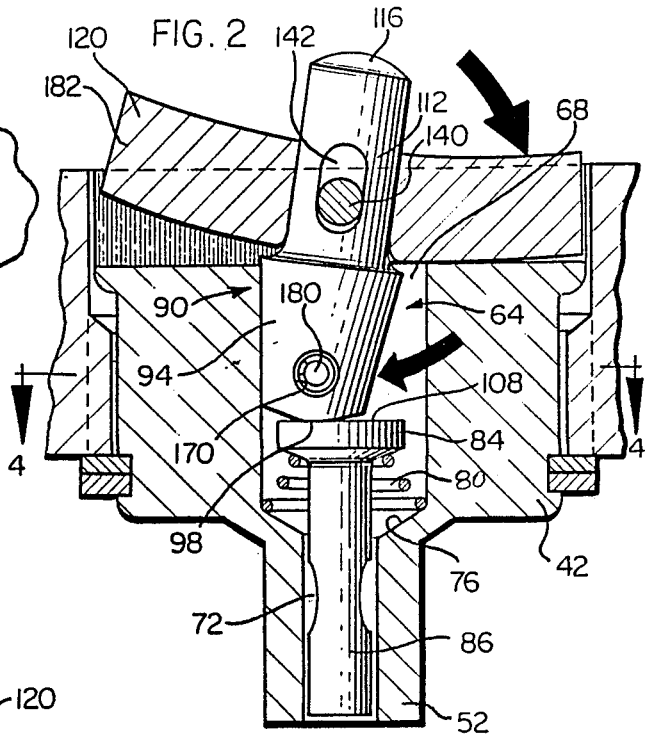
FIG. 3
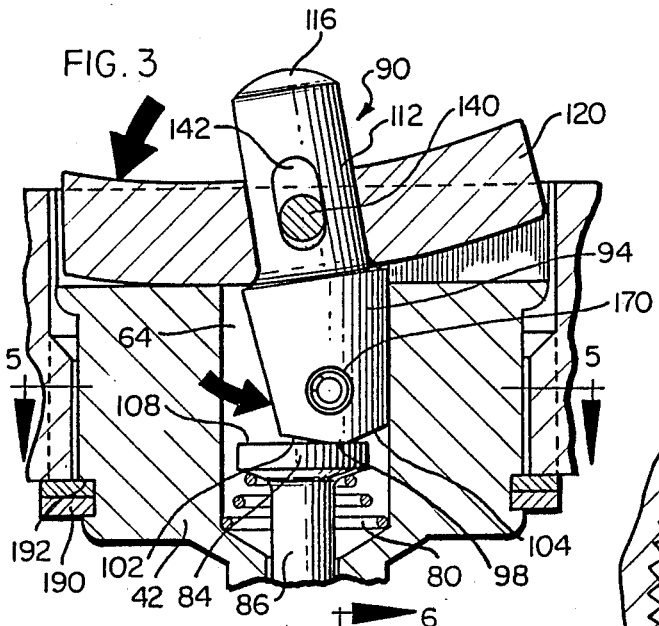
FIG. 4
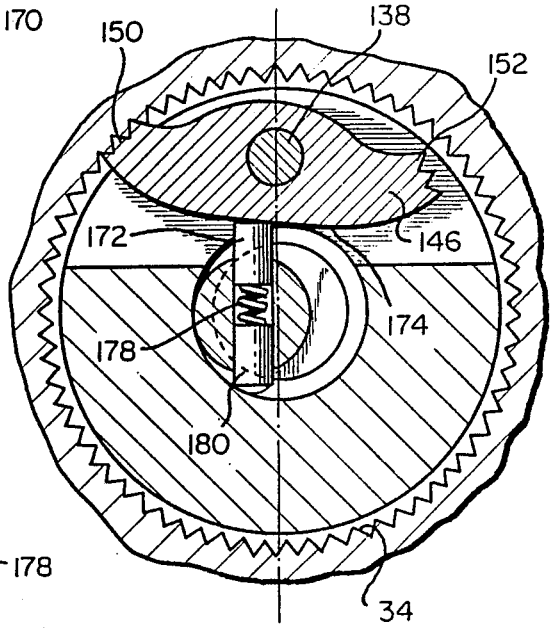
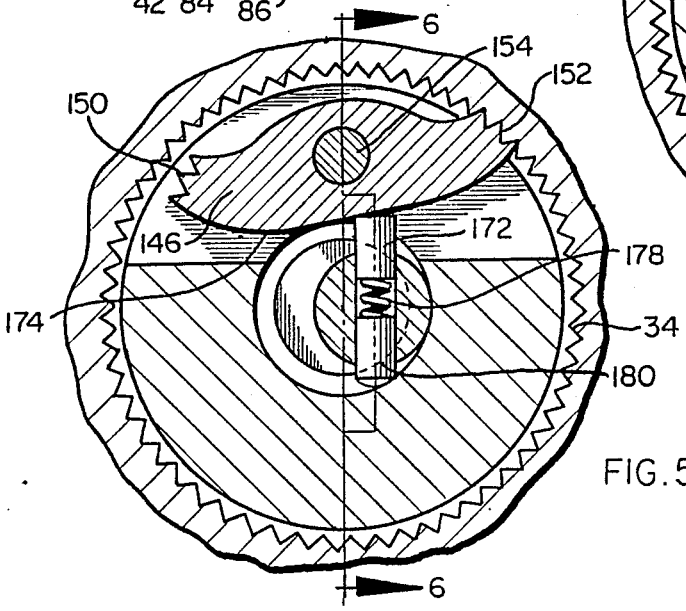
FIG. 5

SOCKET RELEASE ASSEMBLY FOR RATCHET DRIVE

The present invention relates to an improvement in a ratchet wrench drive wrench of the type described in K. K. Chow, U.S. Pat. No. 4,280,379. More particularly, the invention is directed to a rod assembly for securing a tool socket in place and for quickly releasing the socket from a stud or tang of a ratchet wrench of the type in which the drive direction is changed by simply applying digital pressure to a pivotally-operable toggle element projecting upwardly of the head of the wrench.

BACKGROUND OF THE INVENTION

Ratchet wrenches and tools including those of the type which have a socket-locking and quick-release mechanism have been long established in the relevant art. Many and varied types of such mechanisms for ratchet and drive reversing ratchet wrenches have been described in the literature, and mechanisms have been incorporated in commercial ratchet drives sold for use by mechanics. Many of the prior art structures depend upon and invoke substantially the same mechanical principles, each being engineered for use in ratchet drive wrenches in which drive reversal of the wrench is effected by impressing a rotational force on a lever or upon an arcuately-shiftable plate to change the operational orientation of an indexing element. The latter is conveniently a toothed pawl, the teeth of which intercouple or interlock with cooperating teeth formed in a driving collar or ring of the tool head. In such ratcheting devices, counter-rotation of the tool handle effects disengagement of the ratchet teeth to permit the drive handle to be shifted in the opposite direction for subsequent forward reactivation and drive.

Typically, in ratchet drive wrenches of the type referred to, the pawl is caused to shift between two opposed positions in which the toothed ends of the pawl engage, sequentially, at annularly-spaced positions within an encircling toothed drive ring or collar of the tool head, each such shift being correlated with either clockwise or counter-clockwise torque-transmitting engagement between the driving ring or collar and a driven, coaxial body or core coupled to the collar. Conveniently, the core carries a shank, stud or boss for securement of a tool element thereto.

A ratchet wrench which includes the features referred to above is described in Chow U.S. Pat. No. 4,512,218, and the entire disclosure of that patent is hereby specifically incorporated herein by reference to the extent it is not inconsistent herewith.

While the structures of the prior art are suitable for securing and for effecting release of stud-carried, selectable driving tool elements such as sockets in ratchet drive tools of the broad class described, the mechanical arrangements and the specific physical form of the release mechanisms of the prior art cannot be used in a ratchet drive in which the direction reversing indexing mechanism is shifted between each of its two opposed rotational modes through the application of digital pressure on a finger-contact element which projects above a top face of the wrench head and which does not require the application of a rotational force. That is, the reversing indexing mechanism in wrenches in which the present invention finds utility is actuated through force applied such as to produce a component projecting axially into the face of the tool head. The structure described obviates any need to grasp a bar-like key or a ring to rotate the same in the tool head. Such a ratchet drive wrench is shown in K. K. Chow, U.S. Pat. No. 4,280,379, and the entire disclosure of that patent is hereby incorporated by reference to the extent it is not inconsistent herewith.

SUMMARY OF THE INVENTION

A practical feature of the reversible-ratchet wrench in which the present invention finds use is that reversal of the drive direction is conveniently achieved using the same hand in which the tool is held and manipulated. A related feature of the invention is that there is provided a reversing control mechanism which is effectively actuable through the use of one's thumb or forefinger. The reversal may be achieved without releasing the wrench from its manipulative position on a workpiece, and may be accomplished using the same hand which holds the ratchet wrench.

A critical feature of the present invention is that the one hand operation feasibility is preserved; the release of the stud-carried socket is also achieved through digital pressure applied axially inwardly of the face of the tool head. The pressure is impressed against a button which projects above the wrench head and through use either of the thumb or finger of the same hand used to grip and manipulate the drive tool.

Another feature of the invention is that there is provided a rod-controlled detent and that the rod is spring biased to establish a locking mode of the socket on the supporting stud. Digitally effected axial displacement of the rod releases the socket.

In a preferred embodiment of the invention, the improvements and the advantageous features are incorporated in a ratchet drive of the type which includes a driving ring or collar to which a handle is connected, and a driven core or body rotatably journaled within the drive collar and coupled thereto through a shiftable, double-ended, toothed pawl. The pawl is, in turn, moved between two limiting positions, whereby either of the opposed toothed ends of the pawl is brought, sequentially, into meshing engagement with mating teeth carried on an inner periphery of the drive ring for establishing a torque-transmitting relation in either of opposed directions of rotation. The quick release mechanism of the invention has been devised for use with a wrench in which the shifting of the intercoupling pawl and the reversal of the direction of torque transmitting rotation is effected through the simple step of applying digital pressure at the head of the wrench and using the same hand used to hold the tool.

In accordance with the practice of the present invention, operational capabilities of the prior art structures have been enhanced, and a highly functional and practical device has been provided.

It is an important feature of the present invention that the socket release mechanism is operable independently of a drive-reversing toggle plate manipulation.

It is an important feature enhancing the operation and the ease of manipulation of the socket-release mechanism of the invention that there is provided a digitally depressable actuator which is biased to project upwardly of the wrench and which may be forceably depressed axially into the wrench head to effect release of a stud-held drive socket without interfering with the special toggle mechanism used to reverse the driving direction of the wrench.

It is a related feature of the socket releasing mechanism of the invention that the digitally controlled actuator is a mechanical element distinct from a rod which contacts and controls the locking and the release positioning of a socket-engaging detent ball.

Yet another feature of the invention is that operation of the drive direction reversing toggle, including the impressing of a force thereon directed axially into the core of the wrench, does not act functionally to shift or otherwise to interfere with the socket release control rod.

In a preferred embodiment of the present invention there is provided a socket-release-rod actuator which projects upwardly through a pivotally mounted, drive-reversing plate or shift cap lever. The actuator is mounted on the same pin which pivotally supports the toggle plate, and the actuator is formed with a vertically-elongated, transverse, through pin-accepting slot facilitating shifting of the pin-mounted actuator axially in the core of the tool head for locking and for releasing a drive socket carried on a downwardly projecting stud at a base of the core.

Yet another feature of the invention is that a socket carried on a stud of the tool head may be released with the drive direction controlling plate disposed in either of its drive direction controlling pivotal positions.

A related feature of the socket-securing mechanism of the invention is that in the absence of displacement forces applied to a control button, the socket locking rod is biased to assume a mode in which a socket is secured on the driving stud of the wrench head.

Other and further objects, features, and advantages of the invention will become evident upon a reading of the following specification taken in conjunction with the drawing.

BRIEF DESCRIPTION OF THE DRAWINGS

FIG. 1 is a perspective view of a wrench head of a ratchet drive wrench embodying the present invention;

FIG. 2 is an enlarged, cross-sectional view through the head of the wrench, taken on the lines 2—2 of FIG. 1 and showing the drive direction reversing and the socket releasing mechanism with the direction control in one operational mode;

FIG. 3 is a cross-sectional view similar to that shown in FIG. 2 but with the drive direction control mechanism displaced for driving a tool element in an opposite direction;

FIG. 4 is a cross-sectional view taken substantially on the lines 4—4 of FIG. 2 and showing the drive direction controlling pawl pivoted to assume one operational position;

FIG. 5 is a cross-sectional view taken substantially on the lines 5—5 of FIG. 3 and showing the drive direction controlling pawl pivoted to provide a driving direction opposite that shown in FIG. 4;

DESCRIPTION OF THE ILLUSTRATED EMBODIMENT

Figure 6:
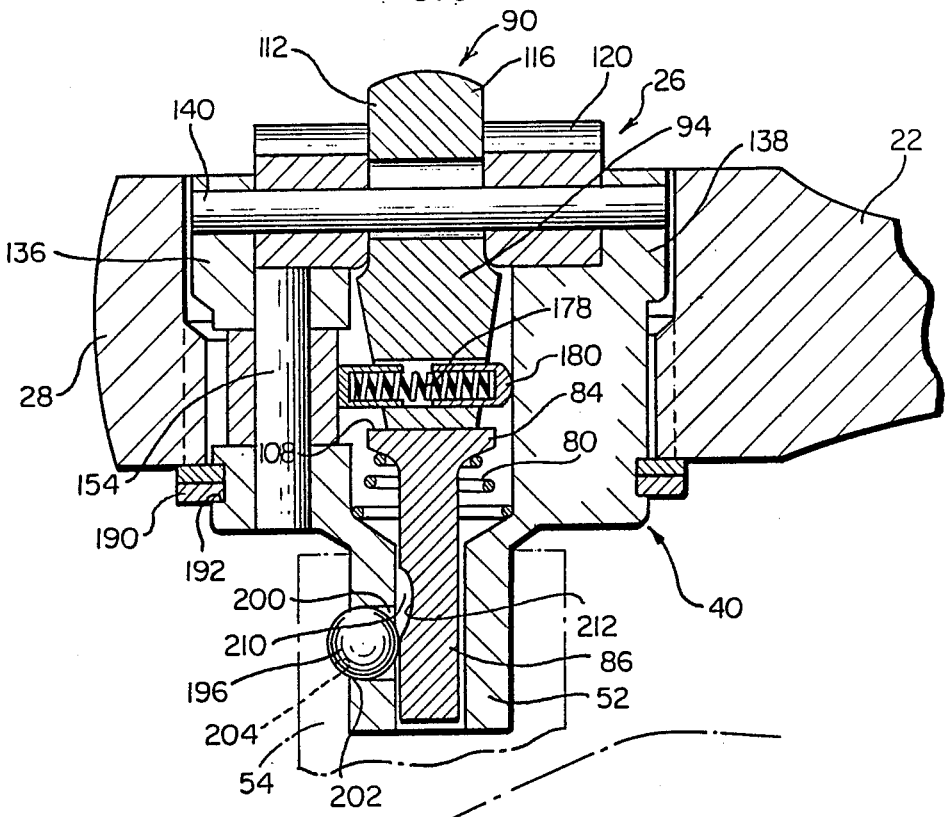
FIG. 6 is an enlarged, cross-sectional view taken vertically through the head of the wrench substantially along the lines 6—6 of FIG. 5 and showing the core structure including the pawl-shifting probe mechanism and with the socket retaining assembly in a socket securing mode.

The aims and objects of the invention are accomplished by providing a mechanism for the quick release of a tool socket in a ratchet drive wrench or similar article of the type in which the drive reversal is achieved by applying finger pressure along a vector, which includes a force component directed axially into the core of the wrench to shift the position of the torque-transmitting pawl of the wrench.

Without interfering with the mechanism for reversing the position of the drive direction controlling pawl, the invention provides a digitally actuable quick release for a tool-held socket. Finger or thumb pressure is applied axially of the head of the wrench against a button projecting outwardly from a face of the tool head and coupled mechanically to a socket securing and releasing rod. Positive displacement of the latter operates, in turn, to release a detent to effect ready and rapid removal of a stud-held socket or other tool element. While preserving the special advantages of the ratchet wrenches of the type described, the present invention provides a unique structural arrangement which incorporates socket-release capability in a specific, unique ratchet drive wrench.

Referring now to the drawings, and more particularly to FIGS. 1 through 3 and 8, there is shown one preferred embodiment of the socket releasing reversible ratchet drive of the invention provided for illustrative purposes and not to be construed in any limiting sense. The ratchet wrench 20 shown includes a handle 22 to which is connected a tool head 26. The latter defines a generally cylindrical drive collar 28 which is formed on its inner generally cylindrical surface with an uninterrupted series of axially extending ratchet teeth 34 evenly and circumferentially spaced around the inner wall surface of the driving ring or collar 28 and projecting radially inwardly thereof A driven body or core 40 rotatably journaled in the collar 28 constitutes the torque-transmitting element of the tool head 20. The core 40 has a generally cylindrical body 42 formed with a transverse recess or cavity 46 (FIG. 8) opening laterally and extending radially inwardly of and from an encircling bounding cylindrical surface 48 of the core 40.

Figure 8:
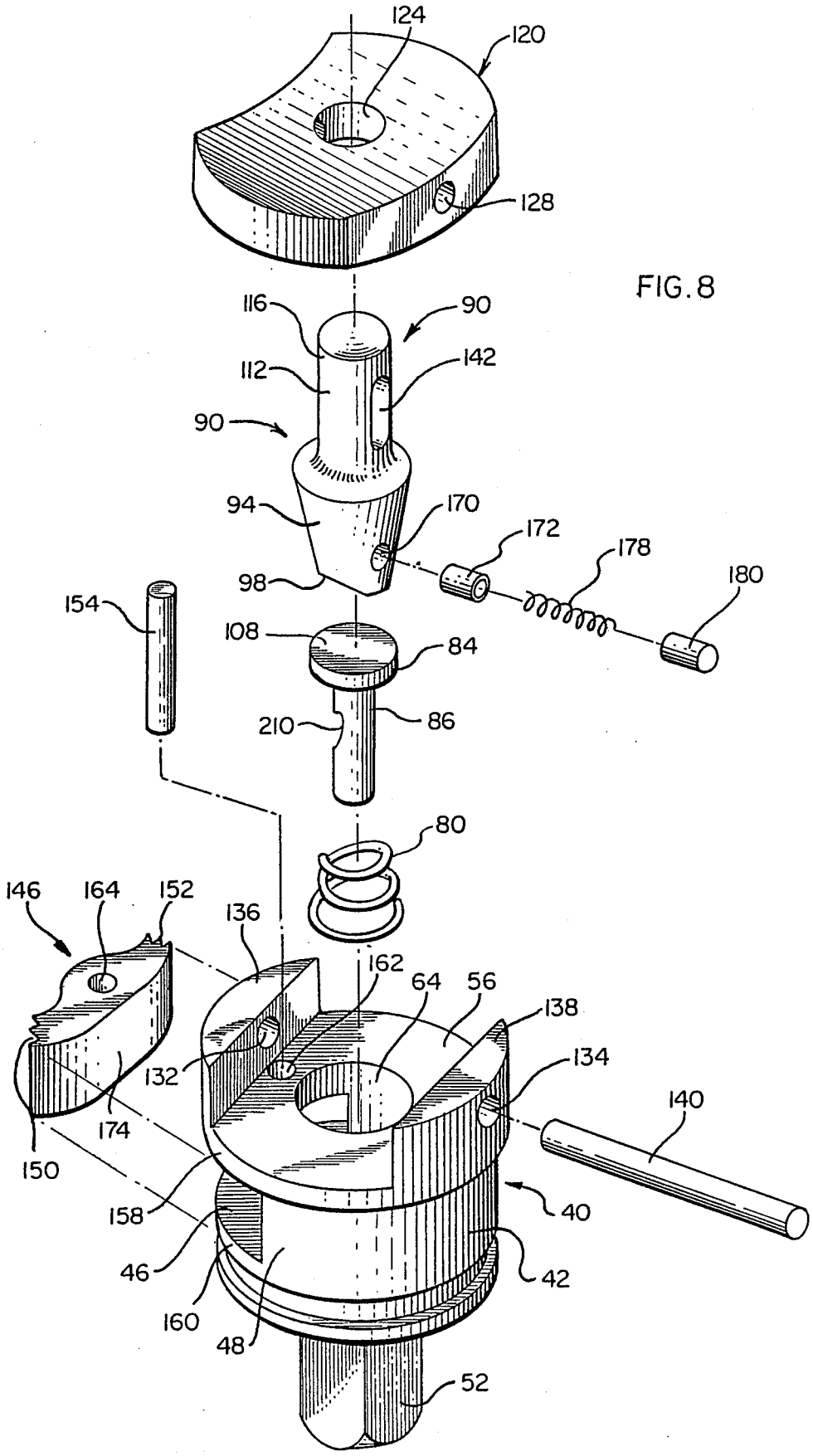
FIG. 8 is an exploded view of the core of the drive wrench of the invention showing the various functional components thereof.

At its lower end the core 40 is integrally formed with a shank, stud, or boss 52 of non-circular transverse cross section for attachment of interchangeable tool elements such as a socket 54 thereto. At its upper, opposite end, the core body 42 is formed with a transversely extending slot 56 which, in the preferred embodiment of the invention depicted is open at opposed lateral ends (FIG. 8). Extending axially inwardly into the core body 42 is a central passage 64 projecting downwardly into the stud 52 and opening at its upper extremity into communication with the slot 56. As shown in FIG. 2, the passage 64 includes an upper section 68 joined to a coaxial lower section 72 of a reduced diameter, through a frustoconical section 76. Seated in the passage 64 and abutting a wall defining the upper terminus of the frustoconical section 76 is a coil spring 80 the upper end of which abuts the under surface of an end plate 84 surmounting and integrally formed with downwardly extending rod 86 which projects into the lower passage 72 in the core 40, for reciprocal movement therewithin and within the stud 52.

Resting on the end plate 84 of the reciprocal rod or pin 86 and secured in the core 40 of the wrench is a pivotally shiftable and longitudinally displacable drive reversing shaft 90. A lower section 94 of the shaft 90 is tapered inwardly and is truncated at its base to provide a pivot fulcrum 98 formed at an intersection of a pair of upwardly angled base surfaces 102 and 104, the pivot fulcrum 98 abutting and bearing upon a top surface 108 of the end plate 84, in each of two selectable toggle modes, all as indicated schematically in FIGS. 2 and 3.

The drive reversing shaft 90 is integrally formed at an upper section 112 with a generally cylindrical body terminating in a digitally presented button 116 which projects above the head 26 of the wrench. A shift cap lever 120, formed with a vertical, transverse through bore 124 is telescoped over the upper section 112 of the drive reversing shaft 90. The shift cap lever 120, which seats in the slot 56, is provided with transverse, horizontally-extending, in-line, through bores 128 aligned for cooperating registry with bores 132 and 134 formed in the cap-bridging wall sectors 136 and 138. The upper, cylindrical section of the drive reversing shaft 90 is formed with a vertically elongated diametrically extending slot 142 which, in the assembled configuration of the ratchet wrench is in line with the slots 128 in the shift cap lever 120 and with the bores 132 and 134 in the wall sectors 136 and 138. A pivot pin 140 extends horizontally through the bores 132 and 134 in the wall sectors 136 and 138, the bores 128 in the shift cap lever 120, and through the slot 142 in the upper section 112 of the drive reversing shaft 90 so that the shift cap lever 120 is secured by and pivotal upon the pin 140, and so that the drive reversing shaft 90 is restrained for pivotal displacement with the shift cap lever 120 and is also susceptible of displacement vertically upon application of downwardly directed digital pressure upon the button 116 extending upwardly of the shift cap lever 120.

As shown in FIGS. 4 through 8, a double-ended, reversible, wing-like pawl 146 having ratchet teeth 150, 152 at its opposed ends is pivotally mounted on a pin 154 secured at its opposed ends in upper 158 and lower 160 walls bounding the cavity 46, the pin 154 passing through cooperating slots 162 in the walls 158 and 160 and through an in-line bore 164 extending vertically through the body of the pawl 146 adjacent a mid zone thereof. As shown, the pawl 146 is so oriented within the recess 46 in the body 42 of the core 40 that the teeth 150 and 152 face radially outwardly from the core body 42 for presentation against and interengagement with the complimentary facing teeth 34 in the drive ring or collar 28 (FIGS. 4 and 5).

As indicated in FIGS. 2 and 3 and as shown more clearly in FIGS. 4 through 8, the pivotally shiftable lower section 94 of the drive reversing shaft 90 is provided with a bore 170 extending diametrically through the base 94 and paralleling generally the apex 98 of the shaft 90. Retained within the bore 170 is a prod or probe 172 which abuts to bear upon a camming surface or face 174 of the pawl 146 at a side of the pawl generally opposed to the pawl-carried teeth 150 and 152, as shown in FIGS. 4 and 5. The probe 172 is spring biased by means of a compression spring 178 confined in the passage 170 and interposed between the prod 172 and an axially in-line bearing stub 180 abutting the body 42 of the core interiorly thereof. In the arrangement shown, and as illustrated in FIGS. 2 through 5, application of finger pressure, sequentially, to an upwardly displaced wing 182 of the shift cap lever 120 imparts pivotal motion and displacement to the lower section 94 of the drive reversing shaft 90 so that the probe 172 slides laterally between each of opposed extreme positions correlated with a coupling of the pawl 146 with the cooperating toothed ring 28 in each of opposed driving modes As shown in the drawings (FIGS. 6 and 7), the core 40 has a diameter slightly less than the inner diameter of the drive ring 28 so that the core 40 is rotatably received and supported within the drive ring 28. A snap ring 190 seated in a cooperating groove 192 encircling the core 40 serves to lock the core body within the ring 28 against inadvertent axial displacement or withdrawal.

The structure by means of which a tool element such as a socket 54 is retained in place and released from the stud 52 is described with reference to FIGS. 6 and 7. In the socket securing configuration, it will be seen (FIG. 6) that there is provided a detent ball or lock ball 196 confined within a port 200 extending radially of and opening outwardly of the stud 52. The ball 196 is confined in the part 200 by a crimped or staked, ridge 202 formed around the outside opening of the port 200. The wall of the vertically extending shiftable pin or rod 86 bears upon the locking ball 196 to urge the latter radially outwardly to seat in a cooperating groove or cutout 204 in the socket 54 or to secure the latter fixed in place on the stud 52.

Figure 7:
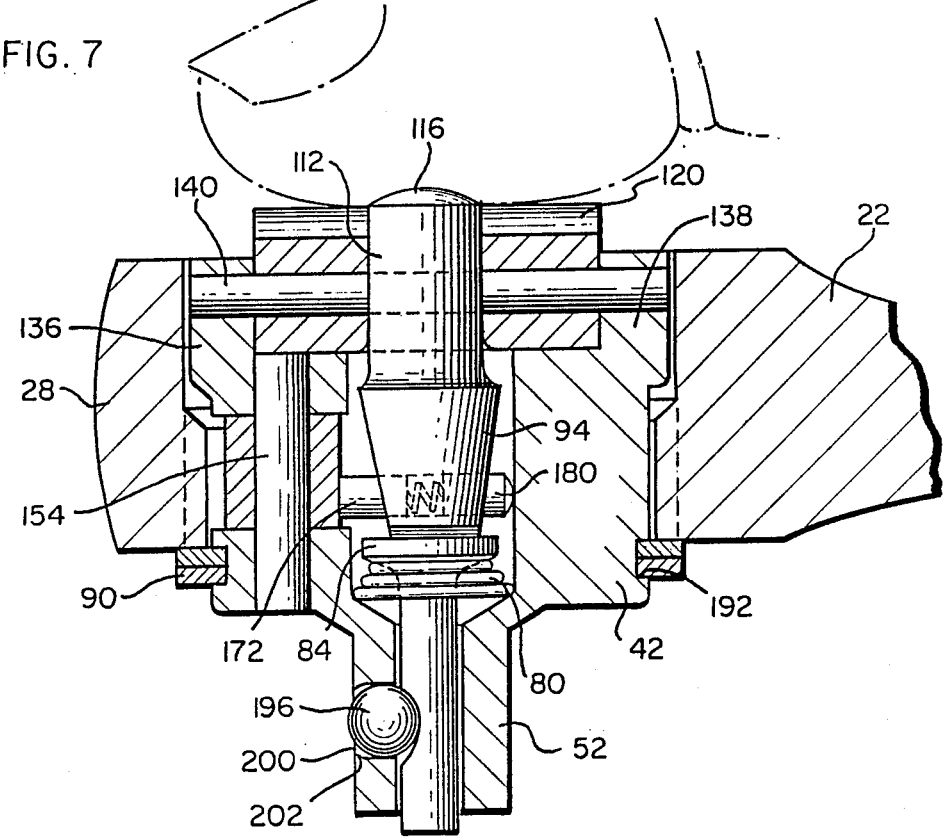
FIG. 7 is an enlarged cross-sectional view similar to that shown in FIG. 6, but with finger pressure being applied axially through the core of the wrench to urge the socket detent controlling rod to assume a socket-re easing mode.

As illustrated schematically in FIG. 7, application of digital pressure downwardly upon the button 116 surmounting the drive reversing shaft 90 serves to compress the biasing spring 80 axially and to displace the rod 86 downwardly. The latter is formed at its lower portion with a cut-out dished zone 210 opening laterally and constituting a recess for receiving the lock ball 196 radially inwardly so that the ball disengages from the socket 54 to free the socket 54 from engagement on the stud 52. The vertically elongated slot 142 in the upper cylindrical section 112 of the drive reversing shaft 90 permits vertical displacement of the shaft 86 without affecting the position of the shift cap lever 120. Release of the button 116 permits the spring 80 to lift the shaft 86 so that a camming surface 212 bounding the dished zone 210 urges the detent ball 196 radially outwardly. Irrespective of the locking or releasing configuration of the ball detent 196, the shift cap lever 120 is readily manipulable to pivot the drive reversing shaft 90 and, concurrently, to shift the probe 172 against the presented wall 174 of the pawl 146 to pivot the pawl between each of reversed driving modes. Again, this is done without interfering with the socket release mechanism.

While the foregoing description of the invention has been made with reference to a preferred embodiment, persons skilled in the art will understand, in the light of the present disclosure, that numerous changes, modifications and alterations may be made therein without departing from the spirit and scope of the appended claims.

What is claimed is:

1. A ratchet wrench including a tool head having a handle-mounted driving ring carrying internal circumferentially-disposed ratchet teeth, a cylindrical core sleeved within and rotatable in said driving ring, tang means carried by said core at an axial end thereof for attachment of a tool element thereto, detent means carried by said tang means and being selectively shiftable between modes including a tool element locking mode and a tool element releasing mode, means for shifting said detent means between said modes, a pivotally-supported, double-ended, ratchet-toothed pawl secured in said core and operating mechanically to intercouple said core with said driving ring through interengagement of complementary respective ratchet teeth of said driving ring and said core-carried pawl and imparting, selectively, bidirectional rotation to said core through application of annular rotational forces to said driving ring, digital-pressure-responsive pawl-actuator means for selectively shifting said pawl to either of two limiting positions for controlling the direction of driving rotation of said core during operational use of said wrench, said pawl-actuator means comprising lever means extending outwardly from a face of said tool head and including shaft means projecting generally axially into said core for effecting displacement of said pawl between two limiting positions correlated with clockwise and counterclockwise driving rotation of said core, means coupling said shaft means and said pawl for translating axial forces applied to said lever means into pawl-pivoting radial forces applied to said pawl, for enabling one using the same hand in which the wrench is held conveniently to reverse the driving direction of the wrench by applying digital pressure to said shaft means of said pawl-actuator means, said means for shifting said detent means comprising a detent locking and release pin extending axially into said tang means for controlling radial positioning of said detent means within said tang means, said pin being formed with a camming wall extending along a side of said pin for engaging said detent means, spring means bearing upon and biasing said pin axially upwardly within said tang means to present said camming wall of said pin to abut said detent means to urge said detent means radially outwardly of said tang means for bearing against and for locking in place a tool element carried by said tang means, said pin being formed with a recess opening laterally thereof for receiving said detent means therein upon displacing said pin axially downwardly within said tang means against opposing biasing forces of said spring means to being said recess opposite said detent means, said shaft means having a lower end thereof abutting an upper end of said pin for transmitting to said pin displacement forces applied digitally to said shaft means, said shaft means having an exposed head portion projecting upwardly of said core of said wrench for facilitating application of digital pressure thereto for displacing said pin axially to bring said recess into lateral registry with said detent means and to allow said detent means to retract into said recess in said pin, thereby to permit release of a tool element carried on said tang means, and said shaft means being formed with a transversely-extending slot for accommodating a pivot rod extending through said shaft means and supporting said pawl-actuator means.

2. The structure as set forth in claim 1 wherein said push probe means is formed adjacent a lower terminal zone thereof with transverse passage means for retaining a pawl-shifting pin, a pawl-shifting pin extending within said passage means and normally of a longitudinal axis of said push probe means for bearing against and for selectively shifting said pawl between opposite driving modes of said wrench upon application of digital pressure to said pawl actuator means.

3. The structure as set forth in claim 2 and further comprising a pivot pin extending transversely of said core and pivotally supporting said pawl actuator means, and wherein said push probe means is formed at an upper end zone thereof with a horizontal slot for accommodating said pivot pin extending therethrough, said slot being elongated vertically for permitting axial displacement of said push probe means upon application of downwardly directed digital pressure thereto.

4. In a ratchet wrench including a tool head having a handle-mounted driving ring carrying internal circumferentially disposed ratchet teeth, a cylindrical core sleeved within and rotatable in said driving ring, stud means carried by said core at a lower axial end thereof for attachment of a tool element thereto, a pivotally-supported, double-ended, ratchet-toothed pawl secured in said core and operating mechanically to intercouple said core with said driving ring through interengagement of complementary respective ratchet teeth of said driving ring and said core-carried pawl and imparting, selectively, bydirectional rotation to said core through application of annular rotational forces to said driving ring, digital-pressure-responsive pawl actuator means for shifting said pawl selectively to either of two limiting positions for controlling the direction of driving rotation of said core during operational use of said wrench, said pawl actuator means comprising lever means extending outwardly from a face of said tool head and including shaft means projecting generally axially into said core for effecting displacement of said pawl between two limiting positions correlated with clockwise and counter-clockwise driving rotation of said core, means coupling said shaft means and said pawl for translating axial forces applied to said lever means into pawl-pivoting radial forces applied to said pawl, for enabling one using the same hand in which the wrench is held conveniently to reverse the driving direction of the wrench by applying digital pressure to said shaft means of said actuator, the improvement comprising, detent means carried by said stud means and being shiftable selectively between functional modes including a tool-element-locking mode and a tool-element-releasing mode, means for shifting said detent means between said modes, said means for shifting said detent means comprising a detent locking and release rod extending axially into said stud means for controlling radial positioning of said detent means within said stud means, said rod being formed with a camming wall extending along a side of said rod for engaging said detent means, spring means bearing upon and biasing said rod axially upwardly within said stud means to present said camming wall of said rod to abut said detent means to urge said detent means radially outwardly of said stud means for locking in place a tool element carried by said stud means, said rod being formed with a recess opening laterally thereof for receiving said detent means therein upon displacing said rod axially downwardly within said stud means against opposing biasing forces of said spring means to bring said recess opposite said detent means, said shaft means being aligned axially with and surmounting said rod for urging said rod downwardly against opposing biasing forces of said spring means, said shaft means having a lower end thereof abutting an upper end of said rod for transmitting to said rod displacement forces applied digitally to said shaft means, said shaft means having an exposed head portion projecting upwardly of said core of said wrench for facilitating application of digital pressure thereto for displacing said rod axially to bring said recess into lateral registry with said detent means and to allow said detent means to retract into said recess in said rod, thereby to permit release of a tool element carried on said stud means.

5. The structure as set forth in claim 4 wherein said shaft means is formed with a bore extending diametrically therewithin, and further comprising a probe slidably disposed in said bore, and spring means within said bore and bearing on said probe to urge said probe to bear resiliently against said camming surface of said pawl.

6. A ratchet wrench having a head encircling driving collar, a core rotatably secured within said collar, a pawl housed in a cavity in said core and engaging said driving collar interiorly thereof, a tool element driving stud attached to said core at a lower end thereof, a toggle-like assembly including digitally-manipulable, pivotally-shiftable, drive-reversing shaft means extending into said core and including a button projecting upwardly therefrom, said drive reversing shaft means including means coupling said shaft means to said pawl for pivotally positioning said pawl for selectively reversing a driving direction of said core and of a tool element carried by said driving stud, drive-reversing-shaft-means-controlled, selectively-operable rod means for locking and for releasing a tool element carried by said stud, said rod means having a lower end section extending axially into said stud and an upper end section in abutment with said shaft means at a contacting lower end thereof, spring means for resiliently biasing said rod means and said shaft means bearing thereon upwardly of said core, and for resiliently supporting said shaft means for selective digital displacement thereof axially downwardly within said core, detent ball means confined in a socket formed in said driving stud and opening laterally thereof for presentation of said detent ball means to a tool element carried on said stud, for releasably securing the tool element in place on said driving stud, said rod means having a laterally-presented wall portion normally abutting said detent ball means for urging said detent ball means radially outwardly of said driving stud, lockingly to engage a tool element mounted on said driving stud, said lower end section of said rod means having a recess formed therein for selectively receiving said detent ball means therein for effecting release of a tool element carried by said driving stud, said recess opening toward said detent ball means but being normally displaced axially upwardly thereof, application of digitally applied pressure against said upwardly projecting button of said drive-reversing shaft means to a degree sufficient to overcome opposing biasing force exerted by said spring means against said shaft means through said rod means being effective to urge said rod means axially downwardly within said core and into said driving stud to bring said recess in said rod means in juxtaposed registry with said detent ball means for permitting entry of said detent ball means into said recess for quickly releasing a tool element carried on said stud

7. The structure as set forth in claim 6 wherein said drive-reversing shaft means is formed adjacent a lower end thereof with a transversely extending tubular passage, prod means slidable in said passage for abutting and for selectively positioning said pawl, a compression spring confined in said passage and extending axially of said prod means for urging said prod means radially outwardly of said passage and into stressing engagement with said pawl along a camming surface thereof for pivoting said pawl from a first to a second operative position and driving mode upon digitally pivotally shifting said drive reversing shaft means.

8. The structure as set forth in claim 6 wherein said core is formed with a chamber for receiving said drive reversing shaft means, said chamber opening upwardly of said core, an annular flange in an upper zone of said core and surmounting said chamber and said drive reversing shaft means retained therein, and further comprising pivot means extending transversely through a slot formed in to extend diametrically through said drive-reversing shaft means at an upper zone thereof, said pivot pin means seating in a pair of opposed retaining bores formed in said core in opposed upper wall sectors thereof.

9. The structure as set forth in claim 6 wherein said drive reversing shaft means is chamfered at a lower end thereof to define a laterally-shiftable, low-friction bearing edge on said shaft means, said bearing edge being presented to bear upon an upper end face of said upper end section of said rod means to facilitate digital manipulation of said shaft means for repositioning said pawl to reverse a driving mode of said wrench.

10. The structure as set forth in claim 8 and further comprising a shift cap lever for manipulating said drive reversing shaft means, said shaft cap lever extending generally normally of a longitudinal axis of said drive reversing shaft means and being formed with a central transverse opening for accommodating said drive reversing shaft means extending upwardly therethrough, and wherein said pivot means extends horizontally through horizontal bores in said shift cap lever and through said drive reversing shaft means for preventing separation thereof axially.

11. The structure as set forth in claim 8 wherein said radially extending slot in said drive reversing shaft means defines a vertically elongated opening for accommodating axial displacement of said drive reversing shaft means transversely with respect to said pivot means extending therethrough.

12. The structure as set forth in claim 9 wherein said lower end of said drive reversing shaft means defines a downwardly presented pivotal apex of said shaft means, a symmetrically disposed pair of sequentially engageable rest bases of said drive reversing shaft means extending upwardly and generally outwardly of said apex and constituting pivotally selectable alternate rest positions for said shaft means, correlated with opposed, selectable driving modes of said wrench.

13. The structure as set forth in claim 12 wherein said rest bases define planar surfaces intersecting at an angle of about 130 degrees.

14. The structure as set forth in claim 10 wherein said central opening in said shift cap lever defines generally cylindrical bounding walls, said bounding walls defining a radially restricted collar confiningly embracing an upper end section of said drive-reversing shaft means, and wherein said drive-reversing shaft means includes a frusto-conical downwardly projecting lower end sector, said lower end sector defining at an upper extremity thereof shoulder means for lockingly restraining said shaft means within said core at said restricted collar thereof to prevent displacement of said shaft means axially upwardly of and to preclude inadvertent withdrawal of said shaft means upwardly through said opening in said shift cap lever of said core.

* * * * *